US005944041A

United States Patent [19]

Kitchens

[11] Patent Number: 5,944,041

[45] Date of Patent: Aug. 31, 1999

[54] PORTABLE BLIND

[76] Inventor: Kirk Kitchens, 115 N. Church St., Tupelo, Miss. 38801

[21] Appl. No.: 09/088,187

[22] Filed: Jun. 1, 1998

[51] Int. Cl.[6] ..... E04H 15/00

[52] U.S. Cl. ..... 135/901; 135/98; 43/1; 124/23.1; 124/86; 124/88

[58] Field of Search ..... 135/90, 901, 98; 43/1; 124/23.1, 24.1, 86, 88

[56] References Cited

U.S. PATENT DOCUMENTS

| | | | |
|---|---|---|---|
| 4,817,579 | 4/1989 | Mathias | 124/23.1 |
| 4,876,817 | 10/1989 | Hill | 43/1 |
| 4,974,575 | 12/1990 | Mitchell | 124/88 |
| 5,127,180 | 7/1992 | Norton et al. | 43/1 |

*Primary Examiner*—Beth A. Aubrey
*Attorney, Agent, or Firm*—Seidal, Gonda, Lavorgna & Monaco, PC

[57] ABSTRACT

A portable hunting blind for attachment to an aiming device, such as an archery bow, a firearm, or other hunting device. The portable blind is a camouflage screen supported by a frame of stay rods extending from a central block. The central block has a first set of sockets for receiving the stay rods in an orientation in which the screen is extended and a second set of sockets for receiving the stay rods in an orientation in which the screen is collapsed. The blind is mounted to the bow or other aiming device by a mounting frame that allows the support frame and camouflage screen to be folded out of the way when carrying the aiming device. Alternative mounting frames are shown for a bow, for a firearm, and for a camera.

9 Claims, 4 Drawing Sheets

PORTABLE BLIND

FIELD OF THE INVENTION

This invention relates to the general fields of hunting blinds and camouflage, and to the more specific field of portable camouflage blinds.

BACKGROUND OF THE INVENTION

A hunting blind is a structure that a person can hide in or behind to mask his or her movements from wild game, yet be able to observe and/or fire upon the game through shooting or observation ports. Stationary blinds usually are either constructed from or covered with natural materials, like branches or reeds, to blend into the surrounding environment, or are covered with a camouflage material in a pattern and coloration to blend into a particular background environment such as various woodlands, prairie, brush, swamp or desert. Portable blinds are generally constructed of some type of light-weight frame that supports a fabric or mesh screen in a camouflage pattern.

Since archery hunting requires relatively close approach of game into shooting range, there has been a development of various portable blinds that attach to and are carried with the bow itself. Representative examples of such blinds are disclosed in U.S. Pat. Nos. 4,817,579 and 4,974,575, and in 4,876,817 and 5,127,180. The later two patents disclose blinds in which the frame can be which collapsed from an extended position to a collapsed position for carrying.

One objective of this invention is to provide a portable blind that has an improved carrying configuration while attached to an archery bow . It would be advantageous to have a blind that collapses and folds out of the way of the arrow rest and bow sights during carrying, so that the hunter can easily draw, aim, and release while stalking and can quickly nock another arrow if presented the opportunity for a follow-up shot. For similar reasons, it would be an advantage to have the collapsed blind folded out of the way of a bow-mounted quiver. It would also be an advantage to have the weight of the collapsed and folded blind generally aligned with the vertical axis of the bow and transferred to the bow at a front stabilizer accessory hole to enable the archer to balance the bow and reduce torque and vibration at release. The present invention attempts to achieve these advantages by features described herein which enable the improved carry configuration.

Another objective of the invention is to provide a collapsible portable blind that can be easily adapted for attachment to an archery bow, rifle or shotgun, camera or camera tripod, tree stand, all-terrain vehicle or other hunting device. Other advantages of the invention may become apparent upon reading the detailed description of the invention which follows.

SUMMARY OF THE INVENTION

The invention is a portable blind for attachment to at hunting device such as an archery bow, a firearm, a camera, a bipod or tripod aiming support, a tree blind, or an all-terrain vehicle. The portable blind is a camouflage screen supported by a frame of stay rods extending from a central block. The central block has a first set of sockets for receiving the stay rods in an orientation in which the screen is extended and a second set of sockets for receiving the stay rods in an orientation in which the screen is collapsed. The blind is mounted to the bow or other aiming device by a mounting frame that allows the support frame and camouflage screen to be folded out of the way when carrying the bow or other hunting device.

DETAILED DESCRIPTION OF THE INVENTION

Figure 1:
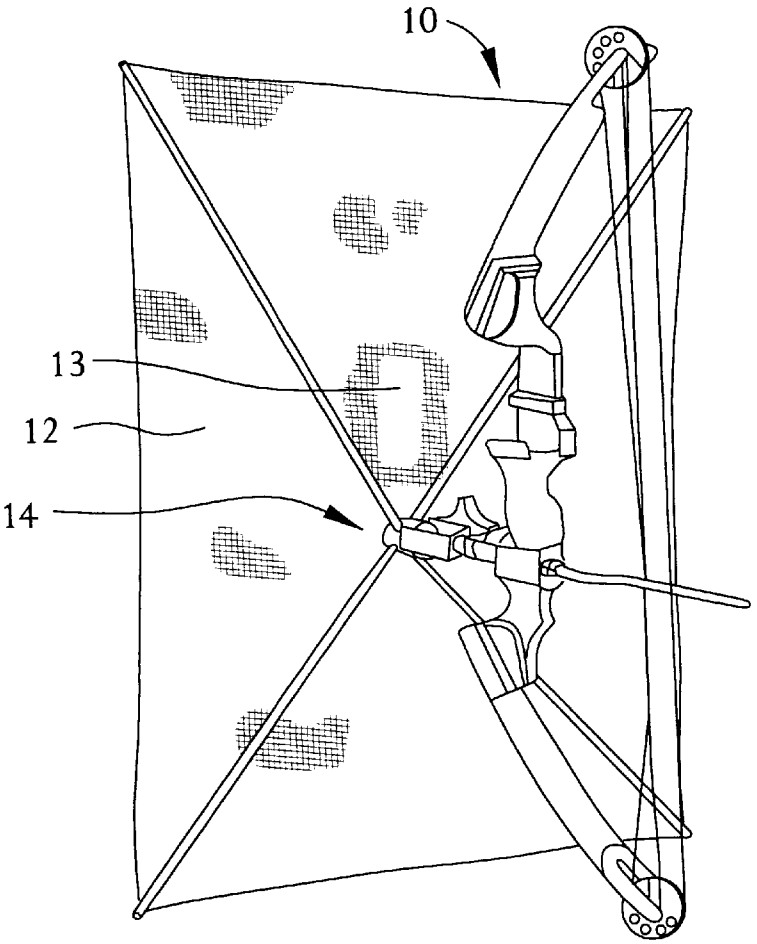
FIG. 1 is an isometric view of a portable blind according to the present invention that is fully extended and mounted on an archery bow.

FIG. 1 shows an embodiment of the invention in which a portable blind (10) is mounted on a compound bow (100). A camouflage screen (12) provides cover for the archer. The screen is usually a sheet of fabric or mesh with a surface pattern adapted to blend into a background environment such as various woodlands, prairie, brush, swamp or desert; but may have a solid appearance such as a white screen to blend into a snow background, or even appear to be the decoy image of a game animal such as a wild turkey. The screen may have ribbons or twines attached, or slits in the material, to simulate rustling leaves or vines. A window (13) is cut out of the fabric for aiming and arrow passage. The depicted camouflage screen is rectangular in shape, but could have other shapes, particularly when simulating a game animal.

Figure 2:
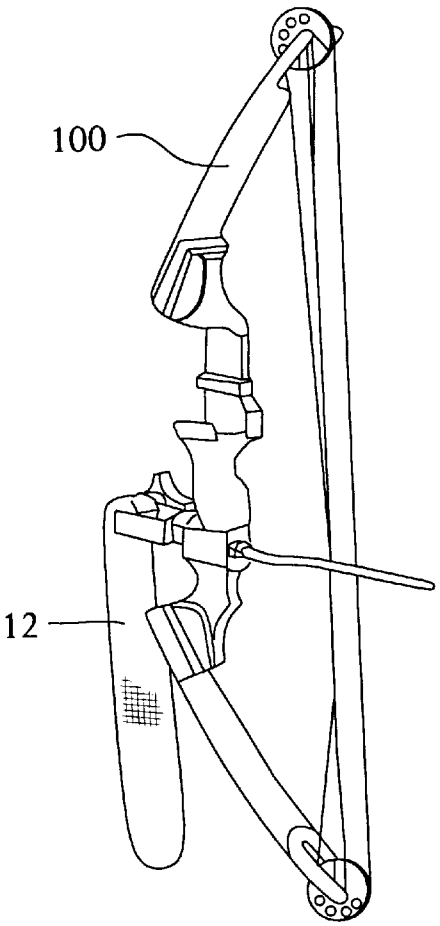
FIG. 2 is an isometric view of a portable blind according to the present invention that has been collapsed and folded for easy carrying while mounted on an archery bow.

A significant aspect of this blind is that it can be collapsed and folded for carry while still attached to the bow, as shown in FIG. 2. The features which enable the blind to be collapsed and folded in this manner are found in its support frame (14) and mounting frame (16), as described below.

Figure 3:
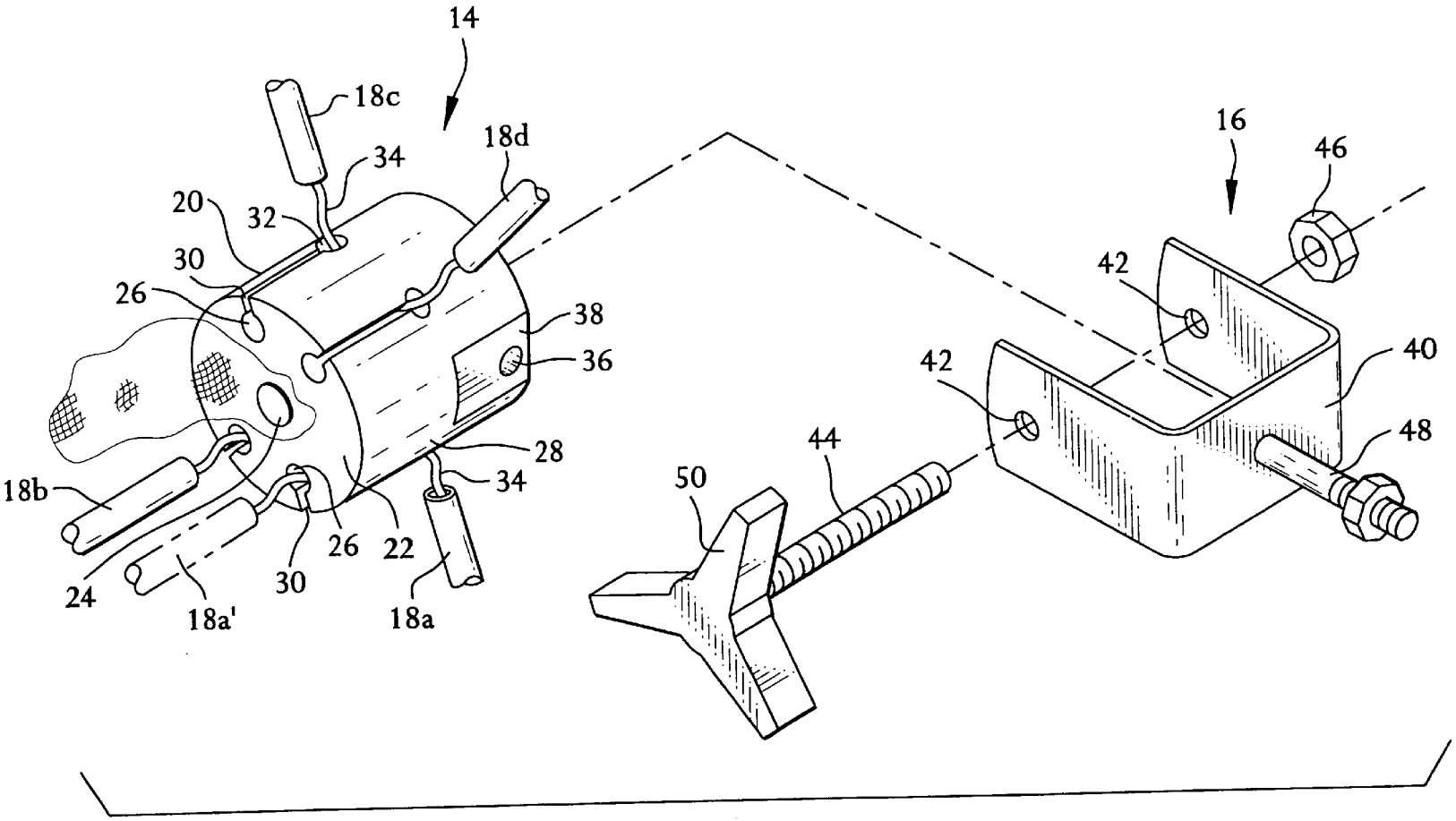
FIG. 3 is an exploded view of the support frame and mounting frame of a portable blind according to the present invention.

As best seen in FIG. 3, the support frame (14) provides a means for supporting the screen in the spread or fully extended condition of FIG. 1, and includes four stay rods (18) inserted into a center block (20). Four stay rods are sufficient to spread a rectangular camouflage screen. Screens of another shape, however, may require additional rods. For example, the upper half portion of a screen in the decoy image of a turkey has a semi-circular shape corresponding to the fanned tail feathers, and uses two additional stay rods extending horizontally from the central block. The camouflage screen may be attached to the stay rods in any conventional manner.

The center block (20) of the support frame is preferably in the shape of a right cylinder, with a front face (22) and circular side wall (28) as shown in FIG. 3, but it could easily have other configurations (rectangle, pentagon, et cetera.) that have flat side walls instead of a circular side wall. In this embodiment, the block's front face (22) has four sockets (26) aligned parallel to the axis of the cylinder to receive the stay rods (18) when the blind is collapsed, and the side wall

(28) has four sockets (32) angled radially toward the cylinder axis to receive the stay rods (18) when the blind is extended. The distribution and spacing of the sockets is related to the rectangular shape of the screen, in which the height of the extended screen is greater than its width. Since it is desired to make the stay rods of equal length, the sockets in the side wall are spaced at intervals to match the rectangular shape (for example, arc intervals of 70°–110°–70°–110° for four rods). The sockets (26,32) are connected in respective pairs by slots (30) between them. Each front socket has an associated side socket, as described below.

In the depicted embodiment, the front face (22) of the center block also has a rivet (24) or removable pin to fasten the center of the camouflage screen to the block, although this fastening feature is not essential.

The operation of the sockets/slots with the stay rods is similar in principle to the upper and lower mounting blocks disclosed in U.S. Pat. No. 5,127,180. As best seen in the exploded drawing of FIG. 3, the stay rods identified by the reference numerals 18*c* and 18*d* are shown pulled out of their respective side sockets (32), while the stay rod identified by the reference numeral 18*b* is shown pulled out from its front socket (32). The stay rod identified by the reference numeral 18*a*, and in phantom line by 18*a*, shows that each of the stay rods can be moved from its front socket to its associated side socket, and vise versa.

Each stay rod (18) is connected to the center block by an elastic cord (34). In the preferred embodiment, the cord connection is actually made through the block to another stay rod; for example, the same cord connects the stay rods identified as 18*b* and 18*d* through a channel in the center block (20), and another similar cord connects the rods 18*a* and 18*c*. The elasticity of the cord pulls the end of the stay rod into a socket, but allows the cord to stretch enough to extract the rod out of one socket, guide the cord through the connecting slot (30), and insert it into the other associated socket.

When all of the stay rods (18) are in the side sockets (32), the blind is in its extended position, with the camouflage screen supported in its full rectangular shape, as in FIG. 1. When all of the stay rods (18) are in the front sockets (26), the blind is in its collapsed position, with the camouflage screen gathered between and around the rods in a generally tubular shape. To fold the support frame and camouflage screen down, out of the way of the arrow rest and bow sights as shown in FIG. 2, involves use of the mounting frame (16). To cooperate with the mounting frame, the support frame (14) has a cross channel (36) drilled through the side of the center block (20), and flats (38) in the circular side wall (28) surrounding the cross channel.

The mounting frame provides a hinged mounting of the central block to the bow around a hinge axis that is generally perpendicular to stay rods when they are in the collapsed condition, and thus allows the support frame and camouflage screen to fold down by rotation of the central block around the hinge. For example, in the preferred mounting frame (14) depicted in the drawings, the hinged mount includes a two-pronged yoke (40), preferably a "⊔" shaped metal channel piece as in FIG. 3, with a pair of bores (42) aligned through the prongs to receive a bolt (44) passing between and through the prongs. The support frame is pivotably connected to the mounting frame by the bolt (44) passing through the cross channel (36) of the center block. The bolt defines the hinge axis of the mounting.

Figure 4:
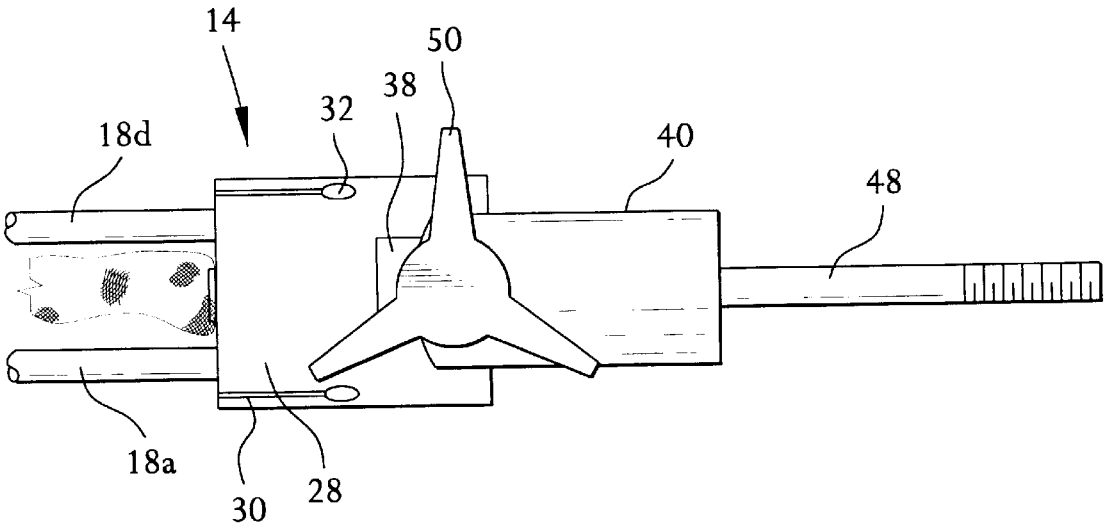
FIG. 4 is a side view of the support frame and mounting frame with the camouflage screen collapsed.
Figure 5:
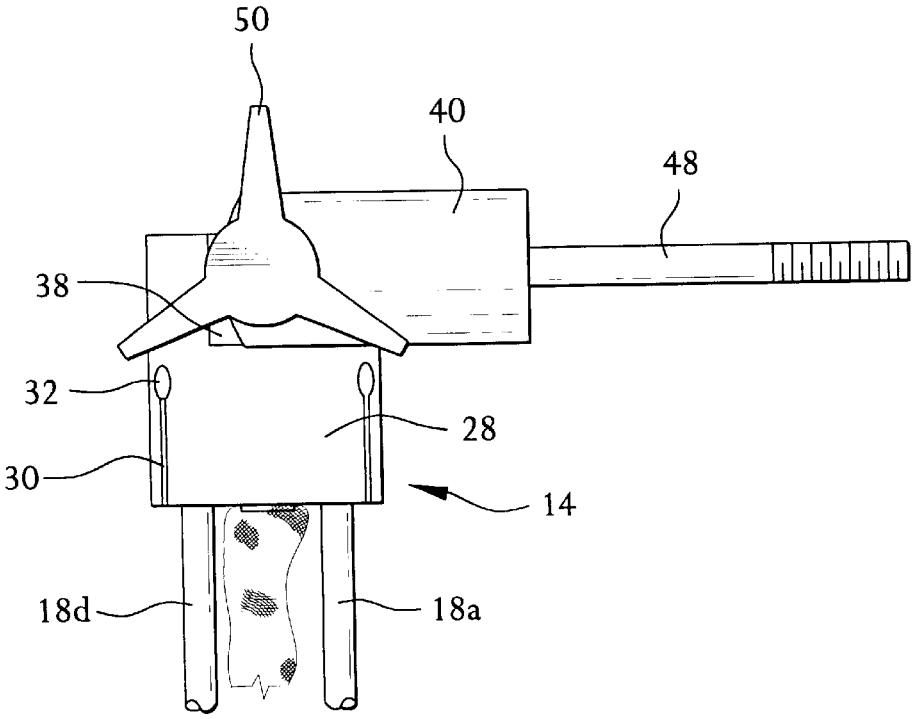
FIG. 5 is a side view of the support frame and mounting frame with the camouflage screen collapsed and folded for carry.

The bolt (44) also provides a means for locking the support frame in the extended position of FIG. 1 or in the collapsed and folded position of FIG. 2. The bolt (44) is preferably threaded and has a finger-grip head (50), and is locked against the yoke (40) by engaging the treads of a nut (46) on the opposite side of the yoke from the bolt. When the bolt head is rotated to advance the bolt into the nut, the prongs of the yoke will press against the center block and lock it in the desired position, either having the front face of the block directed ahead of the bow as in FIG. 4, or directed downward as in the folded position of FIG. 5. The bolt can be loosen by rotating the head in the opposite direction to reposition the support frame.

The mounting frame also has a bar (48) extending from the base of the yoke (40) for connection to the bow. The bar has a threaded tip adapted to screw into the front stabilizer accessory hole in the bow, in a manner similar to that disclosed in U.S. Pat. No. 4,974,575. This point of attachment to the bow makes the weight of the collapsed blind generally aligned with the vertical bow limbs and transfers the weight to the bow at the stabilizer accessory hole to reduce torque and vibration. The archer can counter this weight and balance the bow with a stabilizer bar in the bow's rear stabilizer accessory holes.

Although the preferred mounting frame is the two-pronged yoke and bolt configuration depicted in the drawings, other types of hinged mounting configurations can be used. For example, an "L" shaped bracket (essentially the depicted yoke with one prong removed) with a blot hole could be used with the same bolt as depicted in FIG. 3. Other common types of hinged mount may be used.

The folded support frame is depicted as a generally tubular shape in FIG. 2 because there are several ways of further securing it. One way is with ties or mating strips along its length. However, the preferred way is to use a sheath of camouflage fabric with draw strings at its open end to enclose the entire support frame up to the mounting frame.

Figure 6:
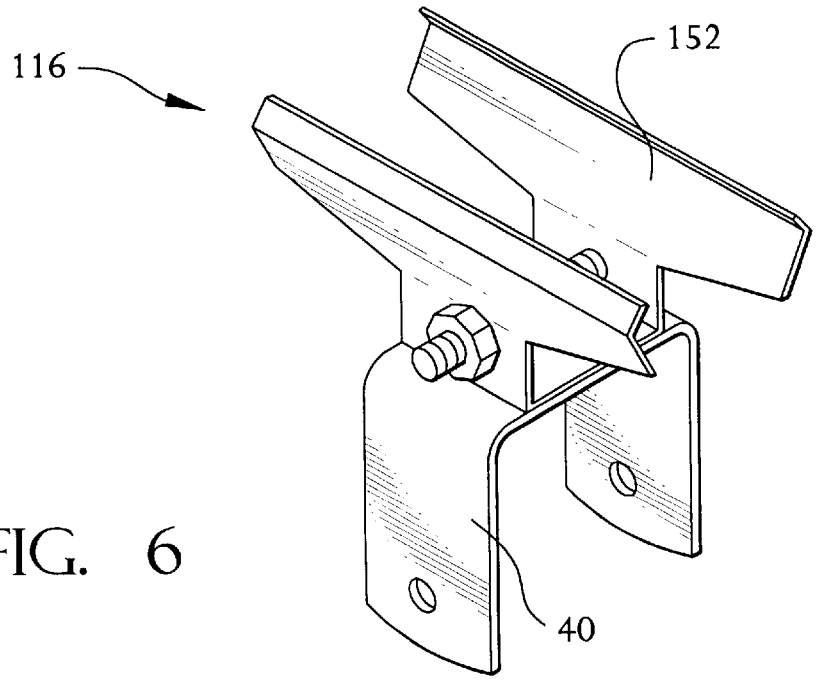
FIG. 6 is a view of an alternative mounting frame for mounting the portable blind to a rifle or shotgun.

The portable blind (10) can by adapted for use with a rifle or shotgun by an alternative mounting frame (116) as shown in FIG. 6. The two-pronged yoke (40) remains the same, but a clamp (152) adapted to engage the barrel or the tubular magazine of a firearm is substituted for the bar (48) of the archery embodiment.

Figure 7:
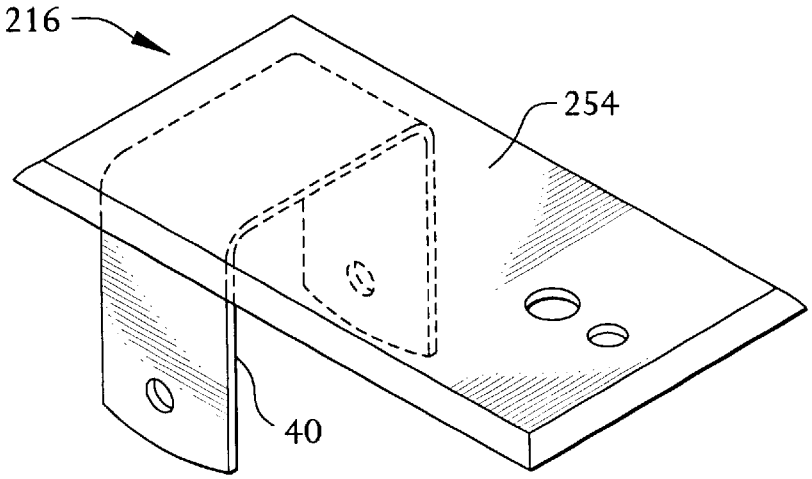
FIG. 7 is a view of an alternative mounting frame for mounting the portable blind to a camera tripod.

The portable blind (10) can also by adapted for use with a camera tripod by an alternative mounting frame (216) as shown in FIG. 7. The two-pronged yoke (40) remains the same, but it is welded to the bottom of a camera mounting plate (254) of the type commonly used to mount cameras on tripods or other camera supports.

The blind (10) may be adapted for other hunting devices, such as a tree stand or an all-terrain vehicle, by attachment of the mounting frame to a suitable structure on the stand or vehicle. Where the term "hunting device" is used in this application, it should be understood in its broadest sense to include non-lethal pursuit such as observation and photography rather than be limited to the harvesting of game.

I claim:

1. A portable blind comprising:

a camouflage screen;

a support frame for supporting the screen, the support frame including stay rods extending from a central block;

the central block having a first set of sockets for receiving the stay rods in an orientation in which the screen is extended, and having a second set of sockets for receiving the stay rods in an orientation in which the screen is collapsed, and a mounting frame for mounting the support frame to a hunting device.

2. A blind as in claim 1, wherein the central block is in the form of a cylinder having a front face and a circular side wall, wherein the first set of sockets is in the side wall and the second set of sockets is in the front face.

3. A blind as in claim 1, wherein the mounting frame includes a two-pronged yoke.

4. A blind as in claim 2, wherein the mounting frame includes a two-pronged yoke.

5. A portable blind for attachment to an archery bow, the blind comprising:

a camouflage screen;

a support frame for the screen, the support frame including stay rods extending from a central block to support the screen in an extended condition, and including means for allowing the support frame to collapse and;

a mounting frame for pivotably mounting the support frame to the bow, the mounting frame comprising a two-pronged yoke.

6. A blind as in claim 5, further comprising a bar extending from a base of the yoke and having a threaded end for attaching the mounting frame to a stabilizer accessory hole in the bow.

7. A blind as in claim 5, wherein the yoke has a pair of bores aligned through the prongs to receive a bolt passing between and through the prongs and through the central block.

8. A portable blind for attachment to an archery bow, the blind comprising:

a camouflage screen;

a support frame for the screen, the support frame including stay rods extending outward from a central block: and a mounting frame for pivotably mounting the support frame to the bow, the mounting frame comprising a two-pronged yoke with a pair of bores aligned through the prongs to receive a bolt passing between and through the prongs and through the central block.

9. A blind as in claim 8, further comprising the central block having a front face and a side wall, a plurality of sockets in said side wall for receiving the stay rods in an extended position, and a plurality of sockets in said front face for receiving the stay rods in a collapsed position.

* * * * *